United States Patent [19]

Stedman et al.

[11] 4,014,446

[45] Mar. 29, 1977

[54] PADDLE-TYPE LOADING MECHANISM FOR REFUSE TRANSPORT

[75] Inventors: Robert N. Stedman, Chillicothe, Ill.; Raymond L. Moser, Hot Springs, Ark.

[73] Assignee: Caterpillar Tractor Co., Peoria, Ill.

[22] Filed: Oct. 22, 1975

[21] Appl. No.: 624,793

[52] U.S. Cl. ..... 214/520; 15/83; 198/518; 214/518

[51] Int. Cl.[2] ..... B65F 3/00

[58] Field of Search ..... 214/6 B, 83, 83.14, 214/83.26, 518–522; 198/7 R, 7 B, 518, 608; 15/83, 340

[56] References Cited

UNITED STATES PATENTS

| | | | |
|---|---|---|---|
| 1,328,521 | 1/1920 | Jemmison | 15/83 |
| 3,668,730 | 6/1972 | Scharmann et al. | 15/83 |
| 3,734,318 | 5/1973 | Kraus | 214/83.26 X |
| 3,802,022 | 4/1974 | Fleming | 214/522 X |
| 3,815,765 | 6/1974 | Moser et al. | 214/82 |
| 3,927,780 | 12/1975 | Dearlove | 214/519 |

*Primary Examiner*—Robert G. Sheridan
*Attorney, Agent, or Firm*—Wegner, Stellman, McCord, Wiles & Wood

[57] ABSTRACT

A refuse transport vehicle having improved structure for picking up bagged refuse placed alongside a roadway. The pickup structure includes paddle structure for lifting the picked-up bagged refuse and transferring it to a portion of the vehicle hopper. To provide improved efficiency in the refuse handling operation, the transferred refuse may be compacted in a compacting portion of the hopper prior to delivery thereof to a storage portion of the hopper. The refuse pickup structure permits the handling of the refuse automatically without the need for additional manual labor with the pickup operation being effected as a concomitant of the travel of the vehicle past the position of the set out bagged refuse.

11 Claims, 4 Drawing Figures

PADDLE-TYPE LOADING MECHANISM FOR REFUSE TRANSPORT

BACKGROUND OF THE INVENTION

1. Field of the Invention

This invention relates to material handling apparatus and in particular to apparatus for handling bagged refuse and the like.

2. Description of the Prior Art

In U.S. Pat. No. 3,815,765 of Raymond L. Moser et al, owned by the assignee hereof, an improved material transport means is disclosed such as for collecting residential-type bagged refuse. The apparatus thereof enables the vehicle to be efficiently loaded and operated by a one-man crew. The apparatus includes an improved pusher mechanism permitting the refuse to be loaded into a front portion of the body, compacted, and stored in a rear portion of the body for subsequent discharge at a dump position. The refuse is deposited into the compacting portion of the mechanism and is automatically transferred to the storage portion by a stuffing mechanism. The compacting portion of the mechanism is disposed at a relatively low level so as to permit transfer of the refuse manually therebetween.

In U.S. Pat. No. 3,734,318 of Johann Kraus, a garbage collection vehicle is disclosed having a conveyor mounted on a cantilever arm for transporting disposable garbage containers from ground level to a collection receptacle mounted on the rear of the vehicle. A frame is mounted on the front end of the cantilever arm and includes guiding means for guiding the garbage containers into the frame. A cross wheel is rotatably mounted on the frame for engaging and pushing the containers onto the conveyor means. The conveyor includes belts carried on suitable rollers. The cantilever extends sufficiently forwardly from the vehicle body to be disposed forwardly of the cab in the pickup operation with the conveyor extending to the front of the collecting body.

Jerry A. Fleming, in U.S. Pat. No. 3,802,o22, shows a litter pickup vehicle which is similar to that of Kraus in providing an arm carried by the vehicle body having at its distal end a pickup mechanism and carrying a conveyor which transfers the picked up litter into the vehicle body. Means are provided for positioning the arm from the cab of the vehicle whereby the apparatus may be used to pick up discarded litter along highways and the like.

SUMMARY OF THE INVENTION

The present invention comprehends an improved refuse handling apparatus utilizing paddle means for transferring the picked up refuse to the vehicle body, or hopper.

More specifically, the invention comprehends providing a wheeled refuse transport vehicle including a hopper, pickup means carried by the vehicle for picking up refuse placed adjacent the path of movement of the vehicle, and paddle means mounted adjacent the pickup means for lifting and transferring the picked up refuse from the pickup means into the hopper.

The paddle means may comprise a first rotary paddle disposed to lift the picked up refuse from the pickup means, and a second rotary paddle disposed to transfer the lifted refuse laterally into the hopper.

The pickup means and paddle means may be carried in a housing which, in turn, may be adjustably supported for selective disposition in a pickup position and a retracted position.

The paddles may be arranged to sequentially engage the refuse in effecting the initial lifting and subsequent lateral translation thereof.

The hopper may include a compaction portion to which the refuse is transferred by the paddle means and wherein the transferred refuse is compacted before delivery to a storage portion of the hopper, thereby permitting handling of a substantial amount of refuse in the storage portion.

The second paddle may further lift the refuse while concurrently laterally translating it to the compaction chamber and the pickup means may be vertically adjusted on the vehicle.

In the storage, or retracted, position, the pickup and paddle means may be disposed transversely of the hopper, and in the illustrated embodiment, are disposed in overlying relationship to the compacting portion thereof.

Thus, the refuse handling apparatus of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
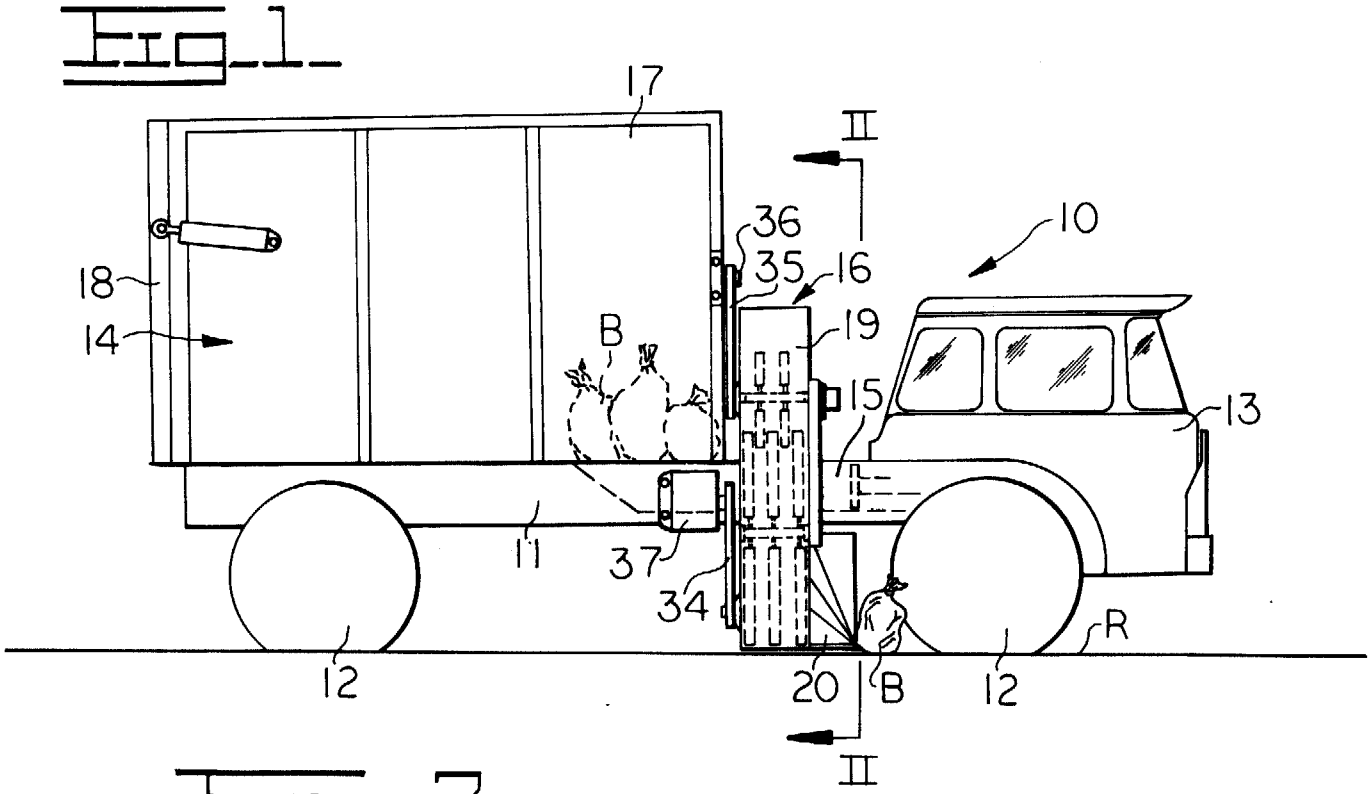
FIG. 1 is a side elevation of a wheeled refuse transport vehicle having an improved refuse handling means embodying the invention.

In the exemplary embodiment of the invention as disclosed in the drawing, a refuse transport vehicle generally designated 10 is shown to comprise a frame 11 provided with suitable drive wheels 12 which may be suitably operated from a cab 13. The frame carries a refuse hopper 14 which may include a compacting portion 15 generally of the type shown in the above-identified U.S. Pat. No. 3,815,765. The vehicle is adapted to be driven along a roadway and to pick up bagged refuse B automatically by a pickup mechanism generally designated 16. Thus, the apparatus of the present invention is adapted for a one-man operation in the collecting of bagged refuse placed along the roadway, such as bagged domestic refuse.

The pickup mechanism is arranged to engage the bagged refuse as set along the roadway R at one side of the vehicle and to transfer the picked up refuse into the compacting portion 15 of the hopper wherein it is compacted and further transferred into a storage portion 17 thereof. The hopper may further include a rear door portion 18 through which the stored compacted bagged refuse is ejected at the dump site.

The pickup mechanism herein comprises an improved means for picking up and transferring the bagged refuse. As shown in FIG. 1, the mechanism includes a housing 19 having a lower compacting chute 20 adapted to engage the bagged refuse B as the vehicle is moved forwardly adjacent thereto.

Figure 3:
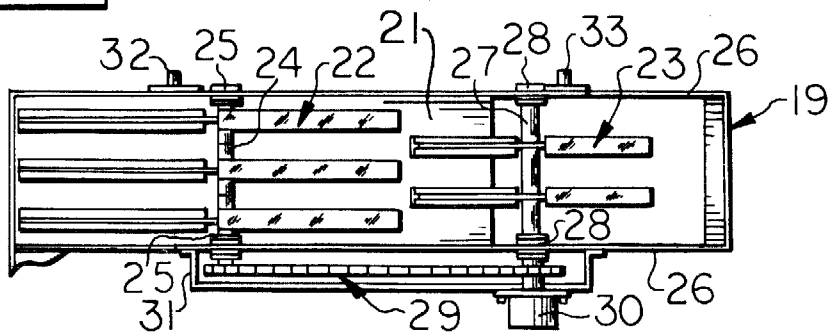
FIG. 3 is an inclined section taken substantially along the line III—III of FIG. 2.

As shown in FIG. 3, the housing further defines a transfer chamber 21 in which a pair of paddles 22 and 23 are disposed. As shown in FIG. 3, the paddles 22 are carried on a shaft 24 journaled in suitable bearings 25 on the sidewalls 26 of the housing. Paddles 23 are carried on a shaft 27 journaled in suitable bearings 28 carried on housing sidewalls 26 in upwardly spaced relationship to paddles 22. The shafts 24 and 27 are driven in synchronization by a chain drive 29 driven by a suitable motor 30 mounted on a chain guard 31 carried on one sidewall 26 of housing 19.

Figure 2:
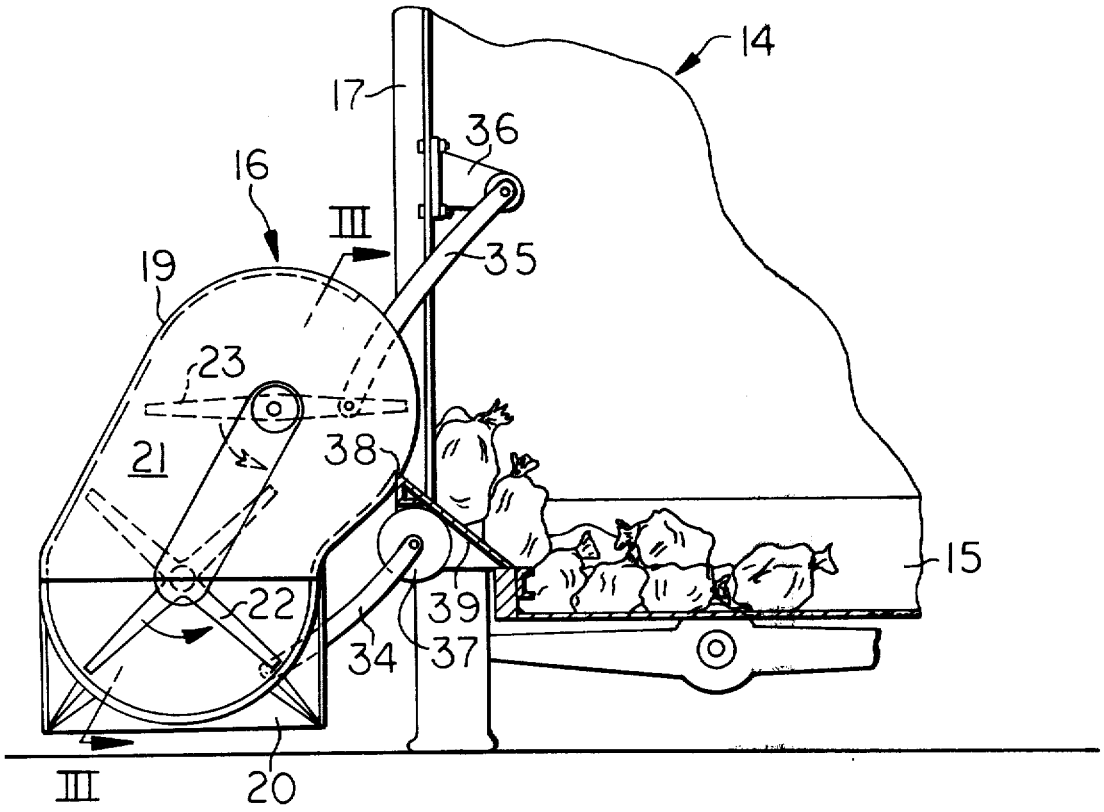
FIG. 2 is an enlarged fragmentary vertical section taken substantially along line II—II of FIG. 1.
Figure 4:
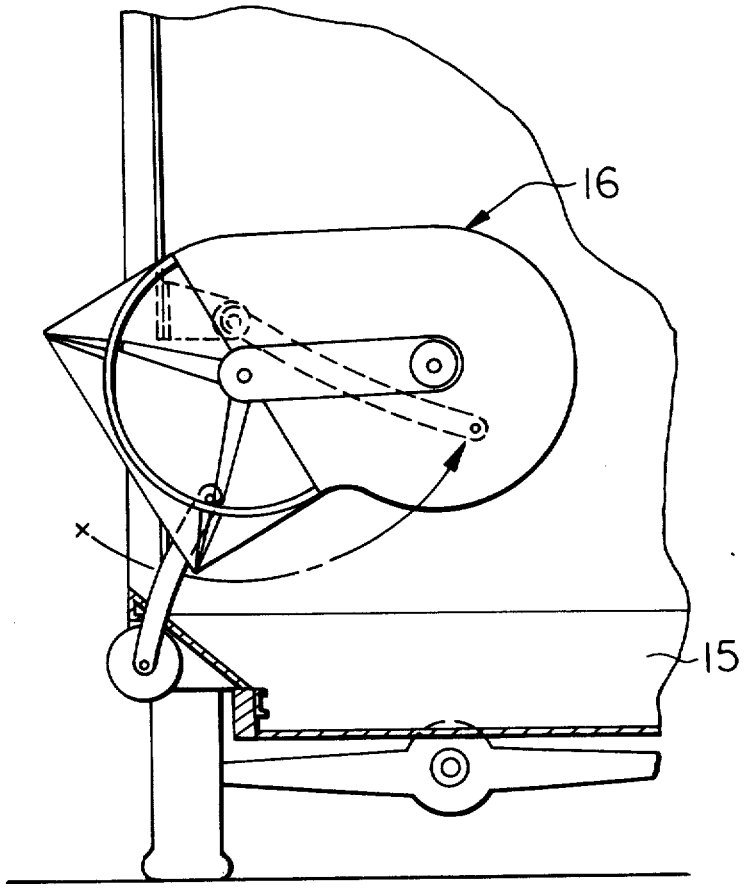
FIG. 4 is a fragmentary vertical section similar to that of FIG. 2 but with the pickup and paddle means in a retracted position.

The housing further carries a pair of pivots 32 and 33. The mechanism is selectively positioned by means of a pair of arms 34 and 35 connected at one end, respectively, to pivots 32 and 33. Arm 35 is connected at its opposite end to hopper portion 17 by an upper pivot 36, and arm 34 is connected at its opposite end to a crank 37 carried on frame 11 of the vehicle. Suitable operation of crank 37 swings arm 34 between the refuse loading position of FIG. 2 and a retracted position of FIG. 4. As shown in FIG. 2, in the loading position, the pickup mechanism 16 is disposed laterally, or at one side, of the hopper portion 15, and as shown in FIG. 4, in the retracted position, the mechanism 16 is disposed in overlying relationship to the hopper portion 15 so as to arrange the vehicle for normal road use.

In the pickup position of FIG. 2, a side opening 38 in the upper portion of the housing 19 overlies a ramp 39 extending downwardly into the hopper portion 15.

Thus, as shown in FIG. 2, when a refuse bag B is delivered to the paddle 22 by its movement onto the lower collecting chute 20, paddle 22 lifts the bag upwardly to be next engaged by the paddle 23. Paddle 23 effects a slight additional lifting of the bag and concurrently urges the bag outwardly through opening 38 onto ramp 39 so as to effect a transfer of the bag into the compacting portion 15 of hopper 14.

The pickup mechanism 16 is relatively small in size while yet being effectively adapted to pick up the bagged refuse and deliver it into the compacting portion of the hopper. By virtue of its compact construction, facilitated selective positioning of the mechanism may be effected by the simple swinging of arm 34, as discussed above. Further, the compact arrangement of the mechanism permits it to be stored behind the cab 13 in the above discussed overlying relationship to hopper portion 15 for overall compactness of the vehicle. In the illustrated embodiment, upper paddle 23 comprises a pair of dual vane paddles and lower paddle 22 comprises three four-vane paddles. The vanes of paddle 23 and those of paddle 22 are synchronized to effect the desired lifting and translating of the bag, as discussed above, by means of the common chain drive 29. As shown in FIG. 3, the vanes of the upper and lower paddles are disaligned for improved transfer of the bagged refuse therebetween.

The crank 37 may be further utilized to swing the arm 34 adjustably to adjust the vertical disposition of the chute 20 so as to adjust the chute for curb and road heights.

The foregoing disclosure of specific embodiments is illustrative of the broad inventive concepts comprehended by the invention.

We claim:

1. In a wheeled refuse transport vehicle having a hopper, the improvement comprising:

pickup means carried by said vehicle at one side thereof for picking up refuse placed adjacent the path of movement of the vehicle; and paddle means mounted adjacent said pickup means for lifting and transferring the picked up refuse from said pickup means into said hopper, said paddle means including a first rotary paddle disposed to lift the picked up refuse from the pickup means, and a second rotary paddle interleaved with said first paddle disposed to transfer the lifted refuse laterally into said hopper, said paddles being rotatable about axes extending generally parallel to said path of movement.

2. The refuse transport vehicle of claim 1 further including a housing carrying said pickup means and said paddle means, and adjustable support means selectively disposing the housing in a pickup position adjacent a side portion of said hopper and in a retracted position above said hopper.

3. The refuse transport vehicle of claim 1 further including a housing carrying said pickup means and said paddle means, and adjustable support means selectively disposing the housing in a pickup position adjacent a side portion of said hopper and in a retracted position above said hopper, said support means comprising pivot means swingably mounting said housing.

4. The refuse transport vehicle of claim 1 wherein said hopper is provided with means defining an inlet at one side of the vehicle, said paddle means being disposed outwardly adjacent said inlet.

5. The refuse transport vehicle of claim 1 wherein said hopper defines a compaction chamber portion and an upwardly open storage chamber portion, and means are provided for compacting the transferred refuse in said compaction chamber for subsequent storage in said storage chamber, said improvement further including a housing carrying said pickup means and said paddle means, and adjustable support means selectively disposing the housing in a retracted position overlying said compaction chamber portion.

6. In a wheeled refuse transport vehicle having a hopper provided with a compaction chamber portion, the improvement comprising:

ramp means carried by said vehicle at one side thereof for picking up refuse adjacent the path of movement of the vehicle;

a rotary paddle mounted adjacent said ramp means for lifting refuse from said ramp means, said paddle being rotatable about an axis parallel to said path of movement; and means for transferring the lifted refuse transversely to said path of movement from said rotary paddle through said inlet into said hopper.

7. The refuse transport vehicle of claim 6 further including a housing carrying said pickup means and enclosing said paddle and transferring means adjacent a side portion of said hopper.

8. The refuse transport vehicle of claim 6 wherein said hopper defines a compaction chamber portion and a storage chamber portion, and means are provided for compacting the transferred refuse in said compaction chamber for subsequent storage in said storage chamber.

9. The refuse transport vehicle of claim 6 wherein said ramp means defines a guide ramp for slidably guiding the refuse being picked up to said rotary paddle with the refuse being delivered to the paddle parallel to said axis.

10. The refuse transport vehicle of claim 6 further including means for vertically adjusting the disposition of said ramp means.

11. The refuse transport vehicle of claim 6 further including means for swingably mounting the ramp means, rotary paddle, and transferring means as a unit for disposition selectively in a pickup position at one side of the vehicle and in a retracted position laterally inwardly of the pickup position.

* * * * *